US010068580B2

(12) United States Patent
Onoda

(10) Patent No.: US 10,068,580 B2
(45) Date of Patent: Sep. 4, 2018

(54) BAND EXPANDER, RECEPTION DEVICE, BAND EXPANDING METHOD FOR EXPANDING SIGNAL BAND

(71) Applicant: JVC KENWOOD Corporation, Yokohama-shi, Kanagawa (JP)

(72) Inventor: Tatsuya Onoda, Yokohama (JP)

(73) Assignee: JVC KENWOOD Corporation, Yokohama-shi (JP)

( * ) Notice: Subject to any disclaimer, the term of this patent is extended or adjusted under 35 U.S.C. 154(b) by 0 days.

(21) Appl. No.: 15/389,474

(22) Filed: Dec. 23, 2016

(65) Prior Publication Data

US 2017/0194013 A1 Jul. 6, 2017

(30) Foreign Application Priority Data

Jan. 6, 2016 (JP) ..... 2016-000947

(51) Int. Cl.

| | |
|---|---|
| ***G10L 25/00*** | (2013.01) |
| ***G10L 19/16*** | (2013.01) |
| ***G10L 19/26*** | (2013.01) |
| ***G10L 25/93*** | (2013.01) |

(52) U.S. Cl.

CPC ..... *G10L 19/167* (2013.01); *G10L 19/265* (2013.01); *G10L 25/93* (2013.01)

(58) Field of Classification Search

USPC ..... 704/500–504

See application file for complete search history.

(56) References Cited

U.S. PATENT DOCUMENTS

| | | | | |
|---|---|---|---|---|
| 5,848,387 | A * | 12/1998 | Nishiguchi | G10L 19/06 704/214 |
| 7,897,864 | B2 * | 3/2011 | Akiyama | G10L 21/038 84/616 |
| 9,380,386 | B2 * | 6/2016 | Fujita | H04R 3/04 |
| 2007/0299655 | A1 * | 12/2007 | Laaksonen | G10L 21/038 704/205 |
| 2009/0107322 | A1 * | 4/2009 | Akiyama | G10H 1/0091 84/616 |
| 2015/0106087 | A1 * | 4/2015 | Newman | G10L 25/78 704/233 |
| 2015/0304775 | A1 * | 10/2015 | Fujita | H04R 3/04 381/94.2 |

FOREIGN PATENT DOCUMENTS

JP 2012-208177 A 10/2012

* cited by examiner

*Primary Examiner* — Leonard Saint Cyr

(74) *Attorney, Agent, or Firm* — Brundidge & Stanger, P.C.

(57) ABSTRACT

An oversampling LPF unit receives a sound signal. A differentiator differentiates the sound signal. An overtone computation unit generates an overtone signal by multiplying a signal differentiated by the differentiator by the sound signal from the oversampling LPF unit. A HPF unit filters the overtone signal generated by the overtone computation unit. A combiner combines the overtone signal filtered by the HPF unit and the sound signal from the oversampling LPF unit.

1 Claim, 5 Drawing Sheets

FIG. 4

| DETECTION RESULT | VOICED SOUND | | UNVOICED |
|---|---|---|---|
| | VOWEL | CONSONANT | |
| GAIN | B | A | 0 |

44

BAND EXPANDER, RECEPTION DEVICE, BAND EXPANDING METHOD FOR EXPANDING SIGNAL BAND

CROSS-REFERENCE TO RELATED APPLICATION

This application is based upon and claims the benefit of priority from the prior Japanese Patent Application No. 2016-000947, filed on Jan. 6, 2016, the entire contents of which are incorporated herein by reference.

BACKGROUND

1. Field

The present invention relates to band expanding technologies and, more particularly, to a band expander, reception device, band expanding method for expanding the band of signals.

2. Description of the Related Art

Technologies for expanding a frequency band are sometimes used to output sound in narrow band sound signals (e.g., signals for analog radio systems) and in irreversibly compressed sound signals (e.g., signals for digital sound communication), for the purpose of improving the intelligibility of sound, improving sound quality, and obtaining sound quality less likely to be embedded in a noise. To expand a frequency band, a frequency domain spectrum is generated by subjecting a sound signal to Fourier transform and a harmonic spectrum is generated based on the frequency domain spectrum. The spectrums are superimposed one on the other and the resultant spectrum is subject to inverse Fourier transform (see, for example, patent document 1).

[patent document 1] Japanese Patent Application Laid-open No. 2012-208177

Using Fourier transform and inverse Fourier transform to expand a frequency band enables natural sound reproduction but increases the volume of computation, and, as a result, power consumption. In communication devices such as wireless devices and, in particular, battery-driven mobile terminals, it is desired that the volume of computation required to expand the frequency band be minimized in order to reduced power consumption.

SUMMARY

To address the aforementioned issue, the band expander according to an embodiment comprises: a differentiator that differentiates an input signal; an overtone computation unit that generates an overtone signal by multiplying a signal differentiated by the differentiator by the input signal; a high-pass filter unit that filters the overtone signal generated by the overtone computation unit; and a combiner that combines the overtone signal filtered by the high-pass filter unit and the input signal.

Another embodiment relates to a band expanding method. The method comprises: differentiating an input signal; generating an overtone signal by multiplying a differentiated signal by the input signal; filtering the overtone signal generated; and combining the overtone signal filtered with the input signal.

Optional combinations of the aforementioned constituting elements, and implementations of the embodiment in the form of methods, apparatuses, systems, recording mediums, and computer programs may also be practiced as additional modes of the present embodiment.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 4 shows a data structure of a table stored in the gain controller of FIG. 3.

DETAILED DESCRIPTION

The invention will now be described by reference to the preferred embodiments. This does not intend to limit the scope of the present invention, but to exemplify the invention.

Embodiment 1

A brief summary will be given before describing the invention in specific details. Embodiment 1 relates to a reception device configured to receive a signal from a transmission device and reconstructs a received sound signal before outputting the signal from a speaker. In particular, the reception device is provided with a band expanding function supplied with the received sound signal as an input signal and expanding the frequency band of the input signal. As mentioned above, it is desired that the volume of computation required to expand a frequency band be prevented from increasing. In addition, the following requirements may be addressed in frequency band expansion. The first requirement is a high correlation between the original sound and the expanded band. The second requirement is that odd-order harmonics are not superimposed and only even-order harmonics are superimposed. This is because, generally, even-order harmonics are annoying and the sound quality will be less uncomfortable by superimposing only even-order harmonics.

In order to address these requirements, the reception device according to the embodiment differentiates an upsampled sound signal and multiplies the upsampled sound signal and the differentiation result so as to generate an overtone signal (a signal including a second harmonic) before causing the overtone signal to pass a high-pass filter (HPF). The reception device also expands the band by adding the overtone signal from the HPF to the sound signal. Fourier transform is not employed so that the volume of computation is prevented from increasing. In accordance with the embodiment, frequency shifting is not used so that high a correlation with the original sound is maintained. In further accordance with the embodiment, an overtone signal is generated so that even-order harmonics are not superimposed.

Figure 1:
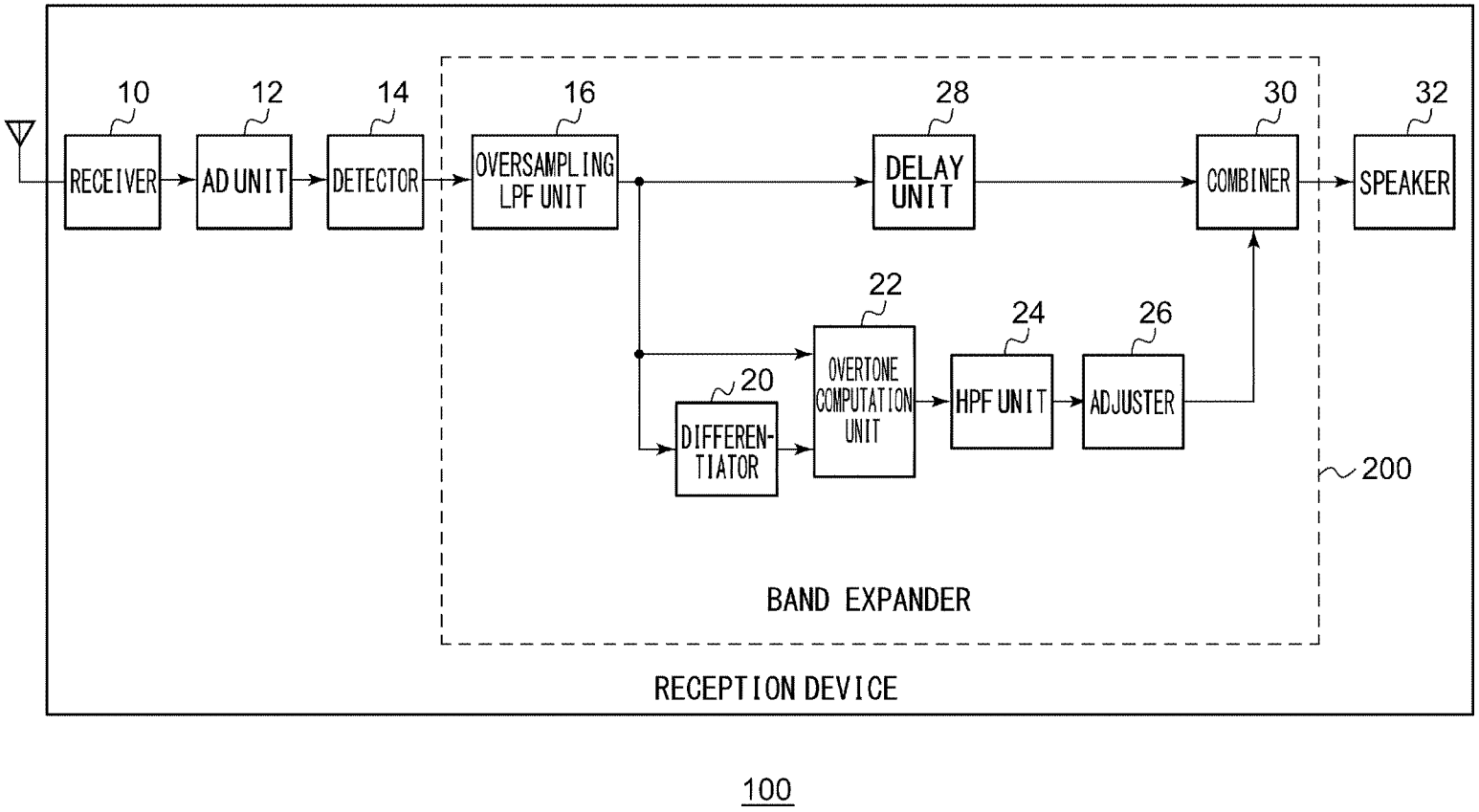
FIG. 1 shows a configuration of a reception device according to Embodiment 1.

FIG. 1 shows a configuration of a reception device 100 according to Embodiment 1. The reception device 100 includes a receiver 10, an AD unit 12, a detector 14, an oversampling LPF unit 16, a differentiator 20, an overtone computation unit 22, a HPF unit 24, an adjuster 26, a delay unit 28, a combiner 30, and a speaker 32. The blocks including the oversampling LPF unit 16 through the combiner 30 are included in a band expander 200.

The receiver 10 receives a signal from a transmission device (not shown). Sound communication between the transmission device and the reception device 100 is subject to the process according to the embodiment so that the received signal contains sound information. A publicly known technology may be used for the signal so that a description thereof will be omitted. The receiver 10 outputs a signal containing sound information (hereinafter, referred to as "sound signal") to the AD unit 12.

The AD unit 12 receives the sound signal from the receiver 10. The sound signal is an analog signal. The AD unit 12 generates a digital version of the sound signal (hereinafter, such a signal is also referred to as "sound signal") by subjecting the sound signal to analog-to-digital conversion. In other words, the AD unit 12 samples the sound signal at a first sampling frequency. For example, the first sampling frequency is set to 8 kHz. The AD unit 12 outputs the sound signal to the detector 14.

Figure 2A:
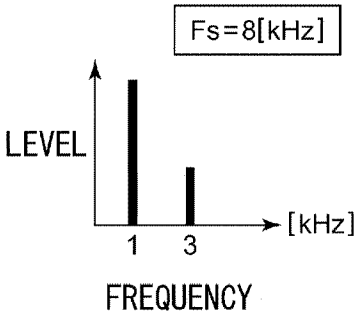
FIGS. 2A-2D show spectrums of signals processed in the reception device of FIG. 1.

The detector 14 receives the sound signal from the AD unit 12. The detector 14 subjects the sound to detection. A publicly known technology may be used for detection so that a description thereof is omitted. The detector 14 outputs the sound signal subjected to detection (hereinafter, also referred to as "sound signal") to the oversampling LPF unit 16. FIGS. 2A-2D show spectrums of signals processed in the reception device 100. FIG. 2A shows an exemplary spectrum of the sound signal output from the detector 14. The horizontal axis represents frequency and the vertical axis represents level. Of the components in the spectrum of the sound signal, only 1 kHz and 3 kHz components are shown for brevity and the other components are omitted. FIGS. 2A-2D will be discussed later and reference is made back to FIG. 1.

The oversampling LPF unit 16 receives the sound signal from the detector 14. As mentioned before, the sampling frequency of the sound signal is 8 kHz. The sampling theorem requires that only those sound signals containing frequencies up to 4 kHz can be represented. In order to expand the band, it is necessary to represent sound signals contain components with an expanded band by increasing the sampling frequency. For this purpose, the oversampling LPF unit 16 converts the frequency of the sound signal into the second sampling frequency higher than the first sampling frequency. For example, the second sampling frequency is set to 16 kHz. To describe it more specifically, the oversampling LPF unit 16 inserts signals of value "0" in the the 8-kHz sound signal before transmitting it through the low-pass filter (LPF). The oversampling LPF unit 16 outputs the sound signal converted into the second sampling frequency (hereinafter, also referred to as "sound signal") to the differentiator 20 and the delay unit 28.

The differentiator 20 receives the sound signal from the oversampling LPF unit 16. The differentiator 20 differentiates the sound signal. To describe it more specifically, the differentiator 20 includes a delay device and a subtractor. The delay device delays the sound signal by one sample and the subtractor computes a difference between the sound signal and the sound signal delayed by one sample. The result of subtraction represents a differentiated value. In the differentiation, a difference between two successive samples is computed. The frequency characteristic is such that the value from the subtraction is small at a low frequency and large at a high frequency. The differentiator 20 outputs the differentiated value to the overtone computation unit 22.

The overtone computation unit 22 receives the differentiated value from the differentiator 20 and the sound signal from the oversampling LPF unit 16. The overtone computation unit 22 generates a signal containing an overtone (hereinafter, referred to as "overtone signal") by multiplying the differentiated value by the sound signal. The process in the overtone computation unit 22 will be described in further details. The sound signal f(t) input to the overtone computation unit 22 is given by as follows.

$$f(t)=A\times\sin(\omega t) \tag{1}$$

Multiplication in the overtone computation unit 22 is given as follows:

$$\begin{aligned} d(A\times\sin(\omega t))/dt\times A\times\sin(\omega t) &= A\omega\times\cos(\omega t)\times A\times\sin(\omega t) \\ &= A^2\omega\times\cos(\omega t)\sin(\omega t) \\ &= A^2\omega/2\times\sin(2\omega t) \end{aligned} \tag{2}$$

The overtone computation unit 22 outputs the overtone signal to the HPF unit 24.

Figure 2B:
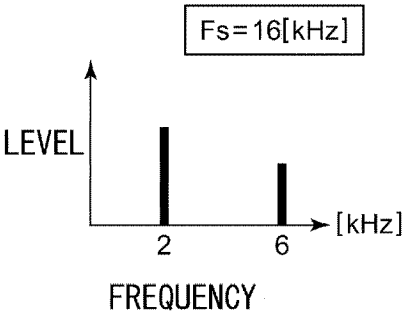

FIG. 2B shows an exemplary spectrum of the overtone signal output from the overtone computation unit 22 and shows a spectrum of the overtone signal generated from the sound signal shown in FIG. 2A. As shown in the figure, the 1 kHz and 3 kHz components in FIG. 2A are shown as 2 kHz and 6 kHz components. Due to the term $A^2\omega/2$ in expression (2), the difference between the 2 kHz and 6 kHz components in FIG. 2B is smaller than the difference between the 1 kHz and 3 kHz components in FIG. 2A. Reference is made back to FIG. 1.

The HPF unit 24 receives the overtone signal from the overtone computation unit 22. The HPF unit 24 is a high-pass filter for extracting high-frequency components in the overtone signal by filtering the overtone signal. The cutoff frequency of the HPF unit 24 is configured to be equal to or less than ½ of the first sampling frequency (e.g., 4 kHz). Therefore, the HPF unit 24 extracts frequency components in the overtone signal higher than 4 kHz. As mentioned above, the signal level of the overtone signal resulting from the multiplication in the overtone computation unit 22 depends on the angular frequency co so that the HPF unit 24 has the characteristics of compensating for the dependence. The HPF unit 24 outputs the filtered overtone signal (hereinafter, also referred to as "overtone signal") to the adjuster 26.

Figure 2C:
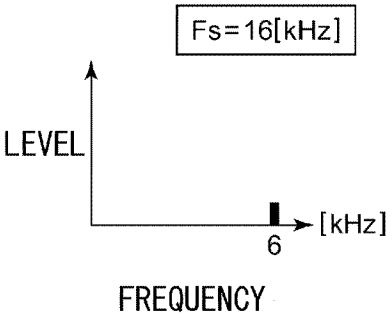

The adjuster 26 receives the overtone signal from the HPF unit 24. The adjuster 26 adjusts the level of the overtone signal. The level of the overtone signal is adjusted according to, for example, a gain for correcting the coefficient ½ in expression (2). The gain is assumed to be a fixed value. The adjuster 26 outputs the overtone signal with an adjusted level (hereinafter, also referred to as "overtone signal") to the combiner 30. FIG. 2C shows an exemplary spectrum of the overtone signal output from the adjuster 26 and shows a spectrum of the overtone signal obtained by subjecting the overtone signal shown in FIG. 2B to the processes in the HPF unit 24 and the adjuster 26. As illustrated, the 2-kHz component in FIG. 2B is attenuated by the HPF unit 24 and the 6-kHz component is extracted. Reference is made back to FIG. 1.

The delay unit 28 receives the overtone signal from the oversampling LPF unit 16. The delay unit 28 delays the sound signal for a period of time required for the processes in the differentiator 20, the overtone computation unit 22, the HPF unit 24, and the adjuster 26. The delay unit 28 outputs the delayed sound signal (hereinafter, also referred to as "sound signal") to the combiner 30.

Figure 2D:
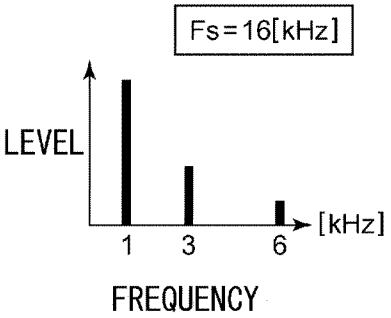

The combiner 30 receives the overtone signal from the adjuster 26 and the sound signal from the delay unit 28. The combiner 30 generates a sound signal with an expanded band (hereinafter, referred to as "band-expanded signal") by combining, i.e., summing, the overtone signal and the sound signal. FIG. 2D shows an exemplary spectrum of the band-expanded signal generated in the combiner 30 and shows a spectrum of the band-expanded signal derived from combining FIG. 2A and FIG. 2C. As illustrated, the 1 kHz, 3 kHz, and 6 kHz components are contained. Reference is made back to FIG. 1. The combiner 30 outputs the band-expanded signal to the speaker 32. The speaker 32 receives the band-expanded signal from the combiner 30. The speaker 32 outputs the sound based on the band-expanded signal.

The features are implemented in hardware such as a CPU, a memory, or other LSI's of a computer, and in software such as a program loaded into a memory, etc. The figure depicts functional blocks implemented by the cooperation of these elements. Therefore, it will be obvious to those skilled in the art that the functional blocks may be implemented in a variety of manners by hardware only, by software only, or by a combination of hardware and software.

According to the embodiment, the sound signal is subject to differentiation and multiplication so as to generate an overtone signal. Therefore, the volume of computation required to expand the frequency band is prevented from increasing. Further, the differentiation process is comprised of delaying and subtraction so that the process is simplified. Since the process according to the embodiment requires low processing load and small memory capacity, the process can be easily built into mobile devices in the low-price zone. Further, filtering of the overtone signal compensates for the characteristic created in generating the overtone signal so that the quality of the signal is improved. Since Fourier transform is not performed, the band can be expanded with a small volume of computation.

Since the overtone signal is generated, even-order harmonics are prevented from being superimposed. Since even-order harmonics are not superimposed, the sound is prevented from becoming annoying. Since frequency shifting is not used, a high correlation with the original sound is maintained. Since a high correlation with the original sound is maintained, natural sound is presented. Since the cutoff frequency of the HPF is configured to be equal to or less than ½ of the first sampling frequency, selected components of the sound signal are removed.

Embodiment 2

A description will now be given of Embodiment 2. Like Embodiment 1, Embodiment 2 relates to reception devices for expanding the frequency band of sound signals. The reception device according to Embodiment 2 generates an overtone signal by multiplying a sound signal by the result of differentiating the sound signal. It should be noted that the sound signal may be voiced sound or unvoiced sound. Further, the sound signal may represent a vowel or a consonant. It is desired to adjust the level of the overtone signal depending on the situation. Therefore, the gain in the adjuster 26 is controlled in accordance with the situation. The following description concerns a difference from the description above.

Figure 3:
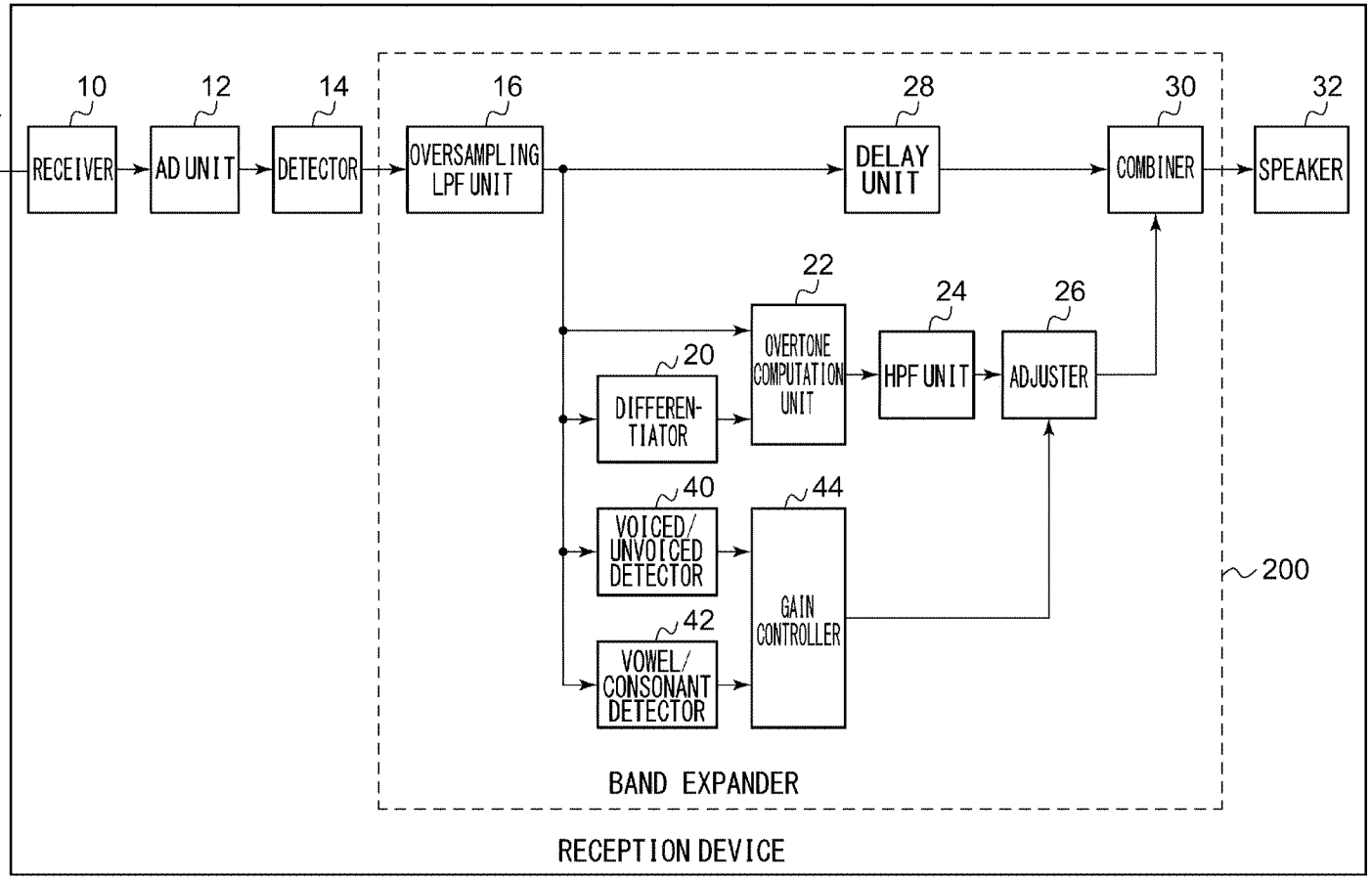
FIG. 3 shows a configuration of the reception device according to Embodiment 2.

FIG. 3 shows a configuration of the reception device 100 according to Embodiment 2. In addition to the features described above, the reception device 100 includes a voiced/unvoiced detector 40, a vowel/consonant detector 42, and a gain controller 44. The blocks including the voiced/unvoiced detector 40 through the gain controller 44 are also included in the band expander 200.

The voiced/unvoiced detector 40 receives the sound signal from the oversampling LPF unit 16. The voiced/unvoiced detector 40 detects whether the sound signal represents a voiced sound or unvoiced sound. To describe it more specifically, the voiced/unvoiced detector 40 transforms the sound signal into the frequency domain. The voiced/unvoiced detector 40 detects whether the sound signal represents a voiced sound or unvoiced sound by performing a spectrum analysis. A publicly known technology may be used for the spectrum analysis so that a description thereof is omitted. The voiced/unvoiced detector 40 outputs the result of detection (hereinafter, referred to as "voiced/unvoiced detection result") to the gain controller 44.

The vowel/consonant detector 42 receives the sound signal from the oversampling LPF unit 16. The vowel/consonant detector 42 detects whether the sound signal represents a vowel or a consonant. To describe it more specifically, the vowel/consonant detector 42 transforms the sound signal into the frequency domain and detects whether the sound signal represents a vowel or a consonant by performing a spectrum analysis. A publicly known technology may be used for the spectrum analysis so that a description thereof is omitted. The vowel/consonant detector 42 outputs the result of detection (hereinafter, referred to as "vowel/consonant detection result") to the gain controller 44.

The gain controller 44 receives the voiced/unvoiced detection result from the voiced/unvoiced detector 40 and receives the vowel/consonant detection result from the vowel/consonant detector 42. The gain controller 44 determines the gain that should be used in the adjuster 26 based on the voiced/unvoiced detection result and the vowel/consonant detection result.

FIG. 4 shows a data structure of a table stored in the gain controller 44. As illustrated, a gain is mapped to each detection result. If the voiced/unvoiced detection result indicates a voiced sound and the vowel/consonant detection result indicates a vowel, the gain controller 44 determines the gain to be "B." Meanwhile, the voiced/unvoiced detection result indicates a voiced sound, the vowel/consonant detection result indicates a consonant, the gain controller 44 determines the gain to be "A." It should be noted that the "A" is greater than "B." In other words, the gain controller 44 configures the gain used when the vowel/consonant detection result indicates a consonant to be larger than the gain used when the vowel/consonant detection result indicates a vowel. If the voiced/unvoiced detection result indicates an unvoiced sound, the gain controller 44 determines the gain to be "0." Thus, the gain controller 44 configures the gain used when the voiced/unvoiced detection result indicates a voiced sound to be larger than that used when the voiced/unvoiced detection result indicates an unvoiced sound. Reference is made back to FIG. 1. The gain controller 44 outputs the gain to the adjuster 26.

The adjuster 26 receives the gain from the gain controller 44. The adjuster 26 adjusts the level of the overtone signal from the HPF unit 24 according to the received gain and outputs the overtone signal with an adjusted level to the combiner 30. As mentioned above, the gain from the adjuster 26 is determined in accordance with the voiced/unvoiced detection result and the vowel/consonant detection result.

According to the embodiment, the level of the overtone signal is adjusted in accordance with whether the sound signal represents a voiced sound or an unvoiced sound so that the overtone signal with a level that matches the content of the sound signal is generated. Further, the gain in the case of a voiced sound is configured to be larger than that of an unvoiced sound so that the impact from noise in the case of an unvoiced sound is reduced. In further accordance with the embodiment, the level of the overtone signal is adjusted in accordance with whether the sound signal represents a vowel or a consonant so that the overtone signal with a level that matches the content of the sound signal is generated. Further, the gain in the case of a consonant is configured to be larger than that of a vowel so that the impact from noise in the case of a vowel is reduced.

Embodiment 3

A description will now be given of Embodiment 3. Like the foregoing embodiments, Embodiment 3 relates to reception devices for expanding the frequency band of sound signals. The reception device generates an overtone signal by multiplying a sound signal by the result of differentiating the sound signal. In Embodiment 3, a quadruple overtone signal (a signal containing a forth harmonic) is generated in addition to an overtone signal. The following description concerns a difference from the description above.

Figure 5:
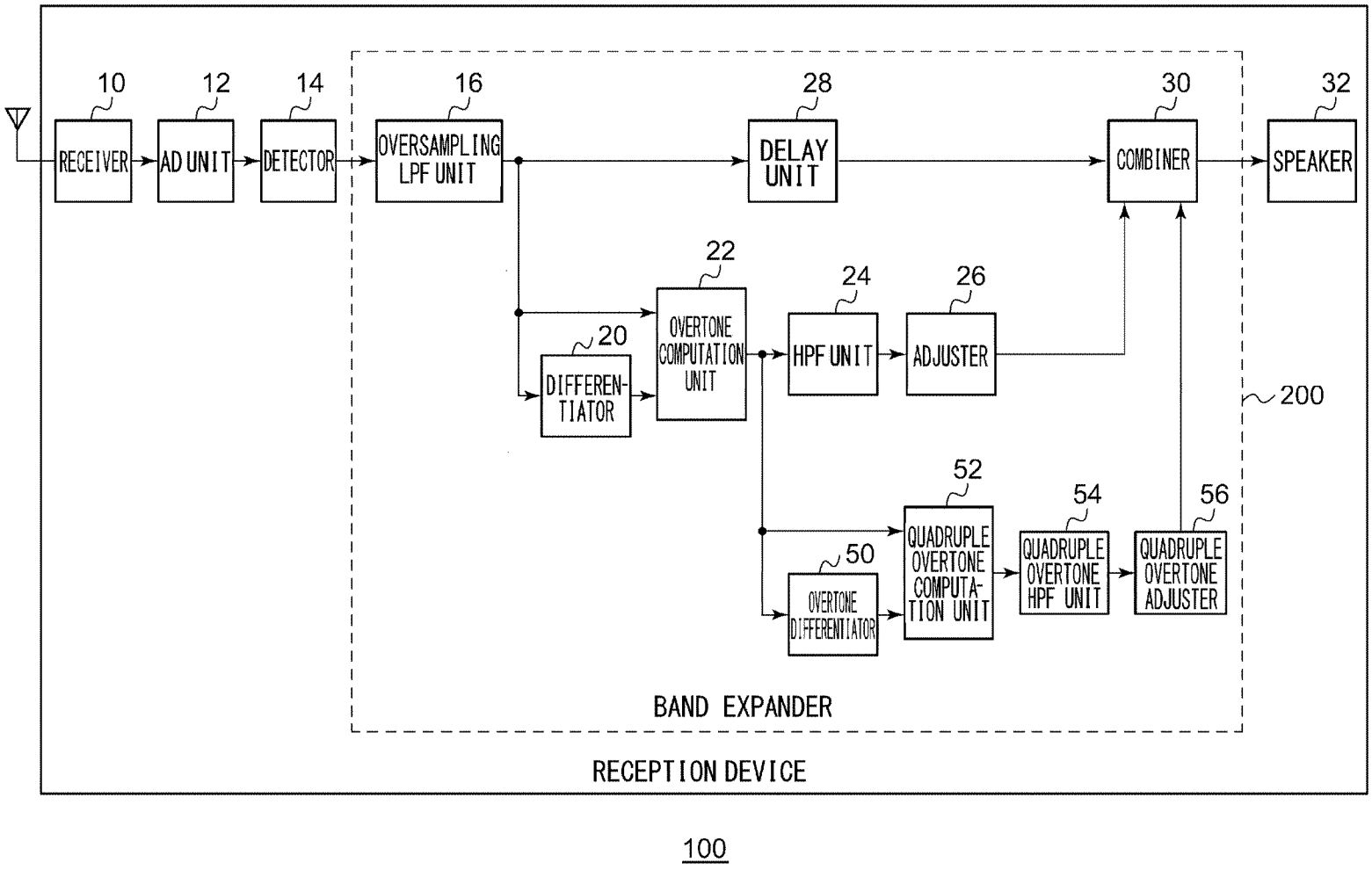
FIG. 5 shows a configuration of the reception device according to Embodiment 3.

FIG. 5 shows a configuration of the reception device 100 according to Embodiment 3. In addition to the features of FIG. 1, the reception device 100 includes an overtone differentiator 50, a quadruple overtone computation unit 52, a quadruple overtone HPF unit 54, and a quadruple overtone adjuster 56. The blocks including the overtone differentiator 50 through the quadruple overtone adjuster 56 are also included in the band expander 200.

As mentioned above, the oversampling LPF unit 16 converts the frequency of the sound signal into the second sampling frequency higher than the first sampling frequency. In this case, generation of a quadruple overtone signal is assumed that the second sampling frequency is configured to be, for example, 32 kHz. The oversampling LPF unit 16 outputs the sound signal converted into the second sampling frequency (hereinafter, also referred to as "sound signal") to the differentiator 20 and the delay unit 28.

The overtone differentiator 50 receives the overtone signal from the overtone computation unit 22. The overtone differentiator 50 differentiates the overtone signal. The differentiation process is similar to that of the differentiator 20. The overtone differentiator 50 outputs the differentiated value to the quadruple overtone computation unit 52. The quadruple overtone computation unit 52 receives the differentiated value from the overtone differentiator 50 and the overtone signal from the overtone computation unit 22. The quadruple overtone computation unit 52 generates a signal of quadruple overtone (hereinafter, referred to as "quadruple overtone signal") by multiplying the differentiated value by the overtone signal. The process in the quadruple overtone computation unit 52 is similar to that of the overtone computation unit 22 so that a description thereof is omitted. The quadruple overtone computation unit 52 outputs the quadruple overtone signal to the quadruple overtone HPF unit 54.

The quadruple overtone HPF unit 54 receives the quadruple overtone signal from the quadruple overtone computation unit 52. The quadruple overtone computation unit 52 is a high-pass filter for extracting high-frequency components of the quadruple overtone signal by filtering the quadruple overtone signal. The cutoff frequency of the quadruple overtone HPF unit 54 is configured to be double the cutoff frequency of the HPF unit 24 (e.g., 8 KHz). Therefore, the quadruple overtone HPF unit 54 extracts frequency components in the quadruple overtone signal higher than 8 kHz. Like the HPF unit 24, the quadruple overtone HPF unit 54 has the characteristics of compensating for the dependence of the signal level of the quadruple overtone signal on the angular frequency $\omega$. The quadruple overtone HPF unit 54 outputs the filtered quadruple overtone signal (hereinafter, also referred to as "quadruple overtone signal") to the quadruple overtone adjuster 56.

The quadruple overtone adjuster 56 receives the quadruple overtone signal from the quadruple overtone HPF unit 54. Like the adjuster 26, the quadruple overtone adjuster 56 adjusts the level of the quadruple overtone signal. The quadruple overtone adjuster 56 outputs the quadruple overtone signal with an adjusted level (hereinafter, also referred to as "quadruple overtone signal") to the combiner 30.

The delay unit 28 receives the sound signal from the oversampling LPF unit 16. The delay unit 28 delays the sound signal for a period of time required for the processes in the blocks including the differentiator 20 through the adjuster 26 and in the blocks including the overtone differentiator 50 through the quadruple overtone adjuster 56. The delay unit 28 outputs the delayed sound signal (hereinafter, also referred to as "sound signal") to the combiner 30. The adjuster 26 also delays the overtone signal for a period of time equal to the difference between a period of time required for the processes in the blocks including the overtone differentiator 50 through the quadruple overtone adjuster 56 and a period of time required for the processes in the HPF unit 24 and the adjuster 26.

The combiner 30 receives the overtone signal from the adjuster 26, the quadruple overtone signal from the quadruple overtone adjuster 56, and the sound signal from the delay unit 28. The combiner 30 generates a sound signal with an expanded band (hereinafter, referred to as "band-expanded signal") by combining, i.e., summing, the quadruple overtone signal, the overtone signal, and the sound signal.

According to the embodiment, the overtone signal signal is subject to differentiation and multiplication so as to generate a quadruple overtone signal. Therefore, the volume of computation required to expand the frequency band is prevented from increasing. In further accordance with the embodiment, the quadruple overtone signal is combined so that the frequency band is further expanded. Moreover, the frequency band is further expanded so that the reproducibility of the sound is improved. In still further accordance with the embodiment, the quadruple overtone signal is generated so that even-order harmonics are prevented from being superimposed.

Described above is an explanation based on an exemplary embodiment. The embodiment is intended to be illustrative only and it will be obvious to those skilled in the art that various modifications to constituting elements and processes could be developed and that such modifications are also within the scope of the present invention.

In Embodiment 2, the voiced/unvoiced detector 40 detects whether a voiced sound or an unvoiced sound is represented, and the vowel/consonant detector 42 detects whether a vowel or a consonant is represented. Alternatively, however, only one of the detections may be made so that the gain controller 44 determines the gain based on the detection result. According to this variation, the configuration can be simplified.

In Embodiment 3, the quadruple overtone signal is generated. Alternatively, however, an 8-tuple or 16-tuple overtone signal may be generated. In this case, the second sampling frequency in the oversampling LPF unit 16 is improved in association. According to this variation, the reproducibility of sound is further improved.

A combination of Embodiment 2 and Embodiment 3 is effective. According to this variation, the combined advantage from Embodiment 2 and Embodiment 3 is obtained.

What is claimed is:

1. A band expanding method, comprising:

outputting a sound signal sampled at a first sampling frequency and sampled at a second sampling frequency higher than the first sampling frequency;

generating a differentiated sound signal by computing a difference between the sound signal and the sound signal delayed by one sample;

generating and outputting an overtone signal containing an overtone of the sound signal by multiplying the differentiated sound signal by the sound signal;

using a cutoff frequency equal to or less than ½ of the first sampling frequency, and generating and outputting a filtered overtone signal by extracting frequency components higher than the cutoff frequency;

combining the overtone signal with the filtered overtone signal;

differentiating the overtone signal by computing a difference between the overtone signal and the overtone signal delayed by one sample;

generating an outputting a quadruple overtone signal containing an overtone of the overtone signal by multiplying the overtone signal differentiated by the overtone differentiator and the overtone signal;

generating and outputting, by a quadruple overtone high-pass filter, of a filtered quadruple overtone signal by extracting frequency components higher than a second cutoff frequency that is double a first cutoff frequency of a high-pass filter unit for a quadruple overtone signal; and combining the filtered quadruple overtone signal, the sound signal, and the filtered overtone signal.

* * * * *